US010507680B2

(12) United States Patent
Deng

(10) Patent No.: US 10,507,680 B2
(45) Date of Patent: Dec. 17, 2019

(54) PRINTING APPARATUS

(71) Applicant: Brother Kogyo Kabushiki Kaisha, Nagoya-shi, Aichi-ken (JP)

(72) Inventor: Yuanyuan Deng, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/135,086

(22) Filed: Sep. 19, 2018

(65) Prior Publication Data

US 2019/0118568 A1 Apr. 25, 2019

(30) Foreign Application Priority Data

Oct. 25, 2017 (JP) ..... 2017-206182

(51) Int. Cl.

| | |
|---|---|
| ***B41J 35/28*** | (2006.01) |
| ***B41J 2/32*** | (2006.01) |
| ***B41J 25/304*** | (2006.01) |
| ***B41J 32/00*** | (2006.01) |
| ***B41J 3/407*** | (2006.01) |
| ***B41J 29/377*** | (2006.01) |
| ***B41J 2/325*** | (2006.01) |

(52) U.S. Cl.

CPC ..... *B41J 35/28* (2013.01); *B41J 2/32* (2013.01); *B41J 2/325* (2013.01); *B41J 3/4073* (2013.01); *B41J 25/304* (2013.01); *B41J 29/377* (2013.01); *B41J 32/00* (2013.01)

(58) Field of Classification Search

CPC . B41J 32/00; B41J 25/304; B41J 2/325; B41J 2/32; B41J 3/4073; B41J 35/28; B41J 29/37

See application file for complete search history.

(56) References Cited

U.S. PATENT DOCUMENTS

| | | | | |
|---|---|---|---|---|
| 5,440,328 A * | 8/1995 | Nardone | B41J 2/325 347/173 |
| 6,390,697 B1 * | 5/2002 | O'Mera | B41J 2/325 347/197 |
| 2009/0214281 A1* | 8/2009 | Makley | B41J 3/36 400/242 |
| 2017/0087909 A1* | 3/2017 | Mochizuki | B41J 3/36 |

FOREIGN PATENT DOCUMENTS

| | | |
|---|---|---|
| JP | 5271630 B2 | 8/2013 |
| JP | 2015-199205 A | 11/2015 |

* cited by examiner

*Primary Examiner* — Kristal Feggins
(74) *Attorney, Agent, or Firm* — Banner & Witcoff, Ltd.

(57) ABSTRACT

There is provided a printing apparatus, including: a base plate having a first surface and a second surface; an installation part provided in the first surface and configured so that a ribbon roll is attached thereto; a thermal head provided in the first surface and configured to heat the ink ribbon; a partition wall partitioning the first surface into a first area including the installation part and a second area including the thermal head; a drive mechanism provided in a third area of the second surface and including a motor and a controller; and a fan provided in the base plate and configured to move air from the second area to the first area via the third area.

5 Claims, 9 Drawing Sheets

PRINTING APPARATUS

CROSS REFERENCE TO RELATED APPLICATION

The present application claims priority from Japanese Patent Application No. 2017-206182 filed on Oct. 25, 2017, the disclosure of which is incorporated herein by reference in its entirety.

BACKGROUND

Field of the Invention

The present disclosure relates to a printing apparatus.

Description of the Related Art

As a printing apparatus configured to perform printing on a printing medium (packaging material, label, and the like) that is conveyed by a conveying apparatus, such as a packaging machine, there is known a thermal printer configured to perform printing on a packaging film. The thermal printer is used by installing a ribbon cassette therein. The ribbon cassette includes a first ribbon core around which an unused ink ribbon is wound and a second ribbon core around which the ink ribbon after printing is wound. The first ribbon core and the second ribbon core of the ribbon cassette installed in the thermal printer are rotated by a drive motor, which unreels or reels out the ink ribbon of the first ribbon core from the ribbon cassette. The thermal printer performs the printing on the packaging film by heating the ink ribbon unreeled from the ribbon cassette with heating elements.

SUMMARY

In the above thermal printer, a drive motor and a controller controlling the drive motor generate heat by being driven. This configuration thus requires a mechanism for cooling the drive motor and the controller (hereinafter referred to as heat generating elements) to allow the thermal printer to stably perform a printing operation. For example, when the heating elements are cooled by airflow generated by a fan, the airflow may move dust and the like to the packaging-film side, affecting printing quality.

An object of the present disclosure is to provide a printing apparatus capable of cooling a heating element while achieving good printing quality.

According to an aspect of the present disclosure, there is provided a printing apparatus, including: a base plate having a first surface and a second surface; an installation part provided in the first surface of the base plate to be rotatable and configured so that a ribbon roll, around which an ink ribbon is wound, is attached thereto; a thermal head provided in the first surface of the base plate and configured to heat the ink ribbon, which is reeled out or unreeled from the ribbon roll depending on rotation of the installation part; a partition wall partitioning the first surface of the base plate into a first area including the installation part and a second area including the thermal head; a drive mechanism provided in a third area of the second surface of the base plate and including a motor configured to rotate the installation part and a controller configured to control the motor; and a fan provided in the base plate and configured to move air from the second area to the first area via the third area.

In the printing apparatus, the fan moves air in the third area from the second area to the first area. In that configuration, the printing apparatus cools the drive mechanism provided in the third area through the airflow, which is generated by the fan. When the airflow is generated by the fan, air flows from the second area to the first area via the third area. Here, the printing apparatus includes the partition wall that separates the first area from the second area. The partition wall of the printing apparatus thus prevents dust and the like carried along with air flowing toward the first area, from moving to the second area. Accordingly, the partition wall of the printing apparatus prevents dust and the like carried along with the airflow, from affecting the printing medium for which printing is performed by the thermal head in the second area.

DESCRIPTION OF THE EMBODIMENTS

<Outline of Printing Apparatus 1>

Figure 1:
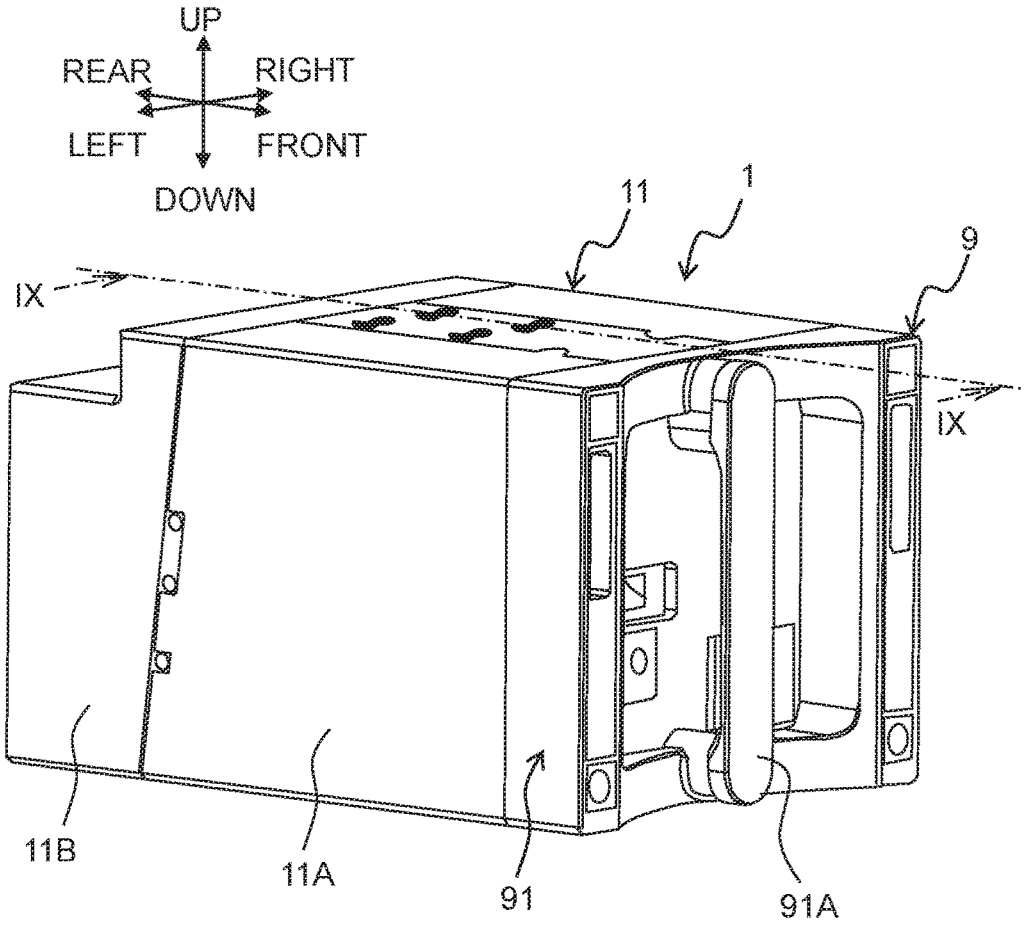
FIG. 1 is a perspective view of a ribbon cartridge 9 and a printing apparatus 1 including a case 11.

Referring to the drawings, an embodiment of the present disclosure is explained. A printing apparatus 1 is a thermal transfer printing apparatus. The printing apparatus 1 performs printing on a printing medium conveyed by an external apparatus (not depicted). The external apparatus is exemplified, for example, by a packaging machine conveying a packaging material. In that case, the printing apparatus 1 is used, for example, by being incorporated into a part of a conveyance line on which the printing medium is conveyed by use of the packaging machine. For easy understanding, the upper side, lower side, left side, right side, front side, and rear side of the printing apparatus 1 and a ribbon cartridge 9 are defined as follows. The upper side, lower side, left side, right side, front side, and rear side of the printing apparatus 1 and the ribbon cartridge 9 correspond respectively to the upper side, lower side, left obliquely lower side, right obliquely upper side, right obliquely lower side, and left obliquely upper side in FIG. 1.

As depicted in FIG. 1, the printing apparatus 1 includes a case 11 having a substantially rectangular parallelepiped shape. The case 11 includes a front-side case 11A and a rear-side case 11B. The case 11A covers a front-side area of the printing apparatus 1 relative to a base plate 21 (see FIG. 3) described below. In the front-side area, installation parts 22 (described below, see FIG. 3), a thermal head 26 (described below, see FIG. 3), a partition wall 27 (described below, see FIG. 3), and the like are provided. The front end and lower end of the case 11A are open. The ribbon cartridge 9 described below is installed in the case 11A via an opening provided in the front end of the case 11A. The ribbon cartridge 9 is installed removably in the printing apparatus 1. An ink ribbon 9A (see FIG. 2) is reeled out or unreeled from a ribbon roll 90 (see FIG. 2) of the ribbon cartridge 9 installed, and then heated by the thermal head 26. Accordingly, the printing apparatus 1 performs printing. The case 11B covers a rear-side area of the printing apparatus 1 relative to the base plate 21. In the rear-side area, a drive mechanism 30 (a motor 31, a control board 36, and the like, see FIG. 6) described below is provided.

<Ribbon Cartridge 9>

Figure 2:
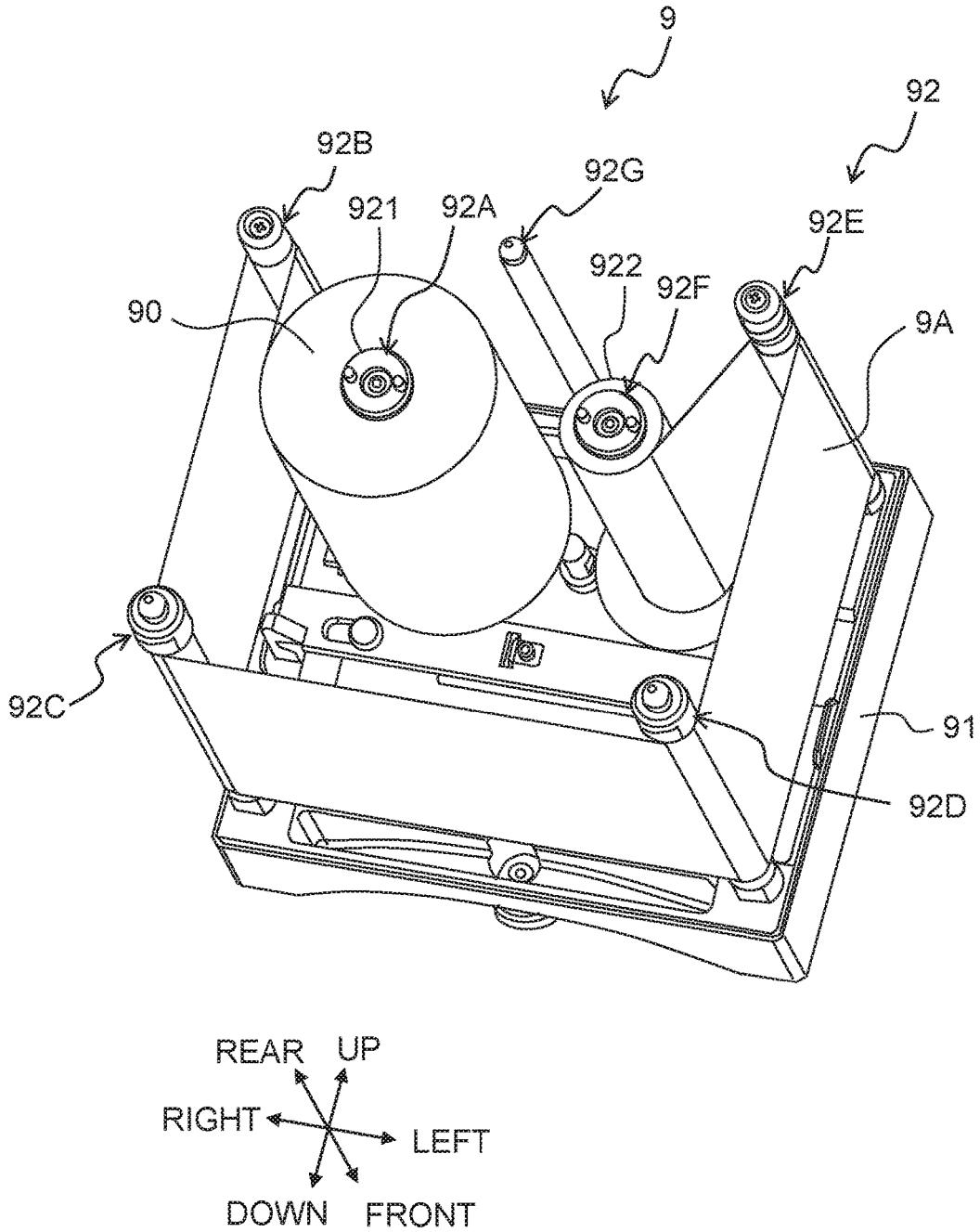
FIG. 2 is a perspective view of the ribbon cartridge 9.

As depicted in FIG. 2, the ribbon cartridge 9 includes a base 91 and shafts 92A to 92G (hereinafter collectively referred to as shafts 92). The base 91 has a substantially square plate shape. The shape of the base 91 is substantially the same as that of the opening of the case 11A (see FIG. 1) of the printing apparatus 1. As depicted in FIG. 1, the front surface of the base 91 is provided with a handle 91A. As depicted in FIG. 2, the shafts 92A to 92G extend rearward from the rear surface of the base 91. Each of the shafts 92A to 92F has a cylindrical shape. Each of the shafts 92A to 92F is a spindle capable of rotating around a rotation shaft extending in the front-rear direction. The shaft 92G, which has a cylindrical shape, is fixed to the base 91.

The shaft 92A is provided on the upper side of the center portion in the up-down direction of the base 91 and on the right side of the center portion in the left-right direction of the base 91. The shaft 92F is provided on the upper side of the center portion in the up-down direction of the base 91 and on the left side of the center portion in the left-right direction of the base 91. The shafts 92A and 92F are arranged in the left-right direction. A spool 921, to which a first end of the ink ribbon 9A is connected, is attached to the shaft 92A. A spool 922, to which a second end of the ink ribbon 9A is connected, is attached to the shaft 92F. In FIG. 2, the ink ribbon 9A is wound in a roll shape around the spool 921 attached to the shaft 92A. In the following, the ink ribbon 9A wound in the roll shape is referred to as a ribbon roll 90. Rotating the spools 921 and 922 reels out or unreels the ink ribbon 9A from the ribbon roll 90, and then the ink ribbon 9A is wound around the spool 922 as a ribbon roll.

The shaft 92B is provided at the upper right corner of the base 91. The shaft 92C is provided at the lower right corner of the base 91. The shaft 92D is provided at the lower left corner of the base 91. The shaft 92E is provided at the upper left corner of the base 91. The ink ribbon 9A stretched between the spools 921 and 922 is in contact with a part of a circumferential surface of each of the shafts 92B to 92E. The shaft 92G is provided at the upper end of the base 91 and at the center portion in the left-right direction of the base 91.

The ribbon cartridge 9 is removably installed in the printing apparatus 1. For example, a user slides and moves the ribbon cartridge 9 rearward relative to the printing apparatus 1 while holding the handle 91A (see FIG. 1) of the ribbon cartridge 9. This inserts the shafts 92 of the ribbon cartridge 9 into the printing apparatus 1 such that the front ends of the shafts 92 are at first inserted into the printing apparatus 1 via the opening (see FIG. 1) provided in the front end of the case 11A. Accordingly, the ribbon cartridge 9 is installed in the printing apparatus 1.

<Base Plate 21>

Figure 3:
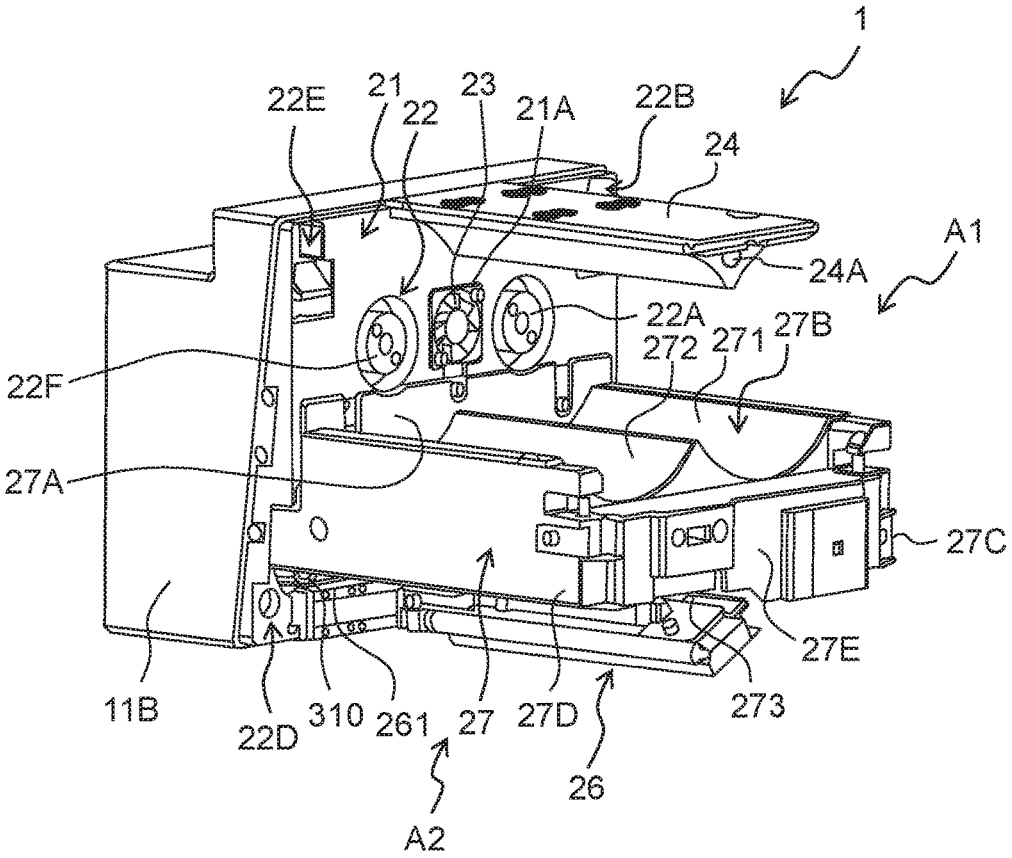
FIG. 3 is a perspective view of the printing apparatus 1 when seen from the front side.
Figure 4:
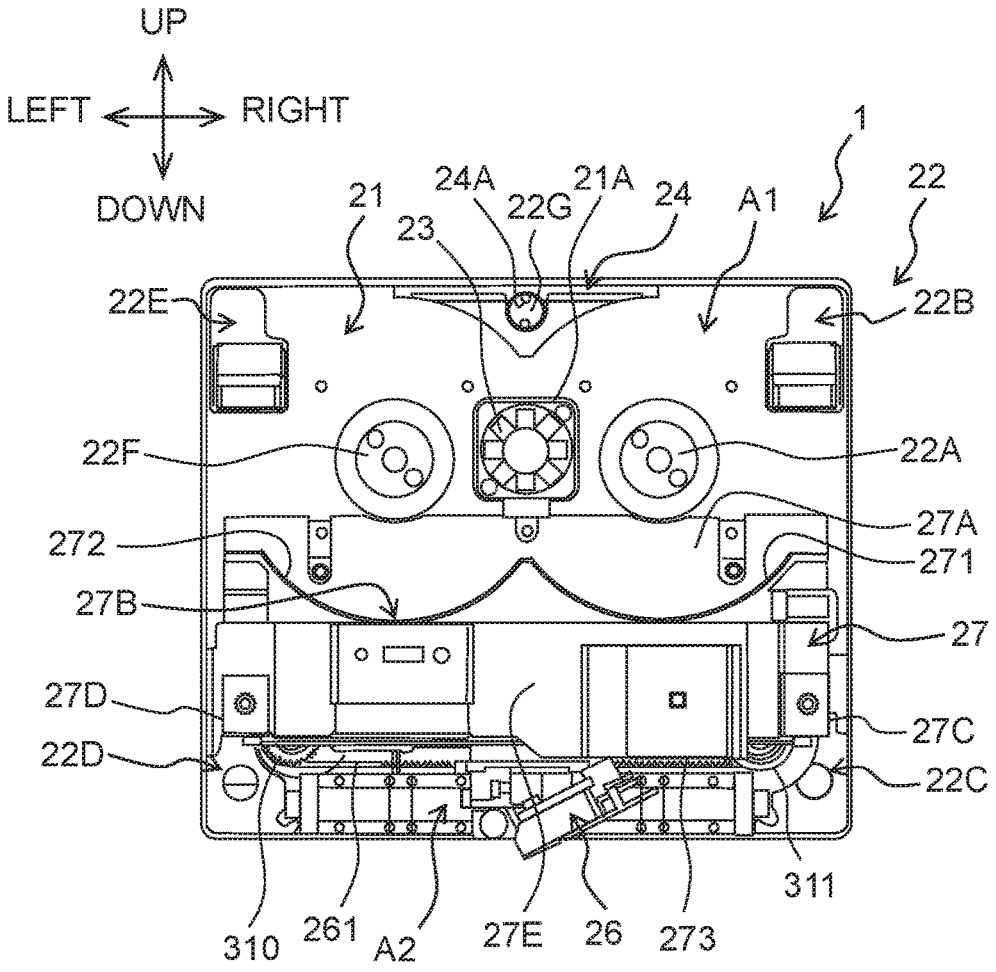
FIG. 4 is a front view of the printing apparatus 1.
Figure 5:
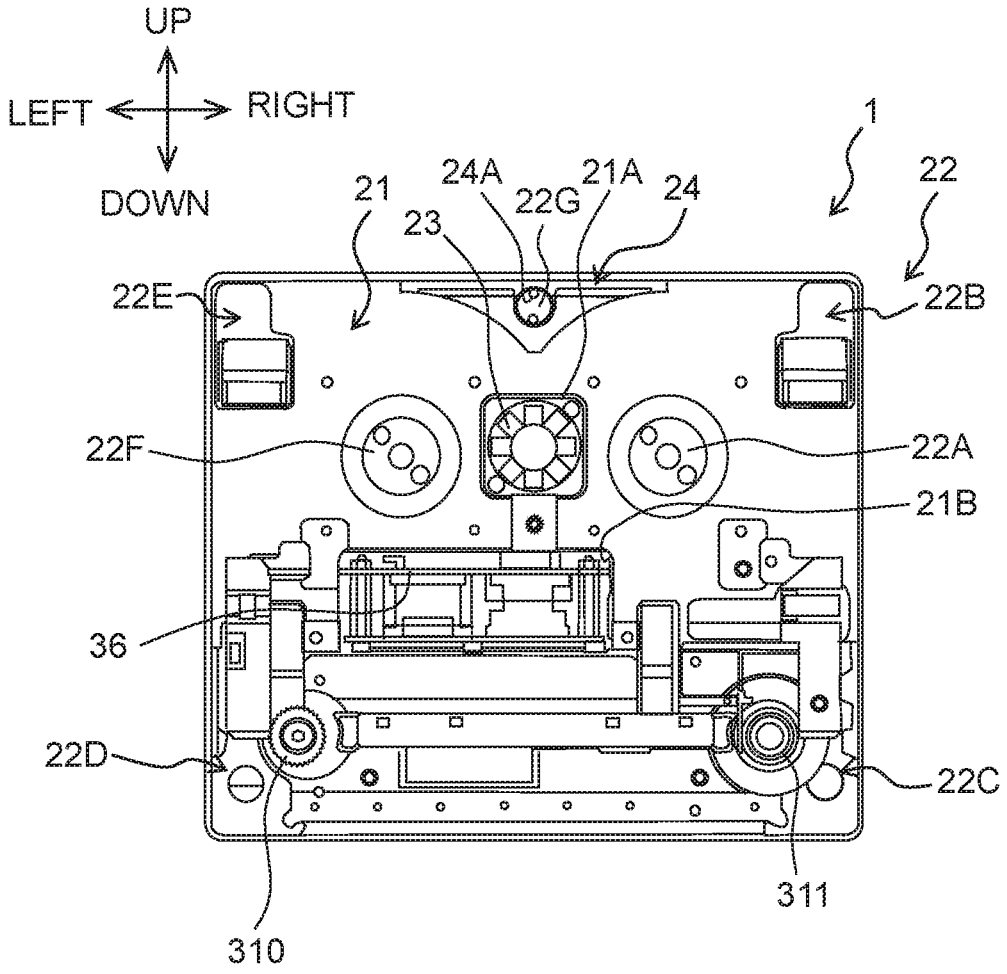
FIG. 5 is a front view of the printing apparatus 1 from which a partition wall 5 is removed.

As depicted in FIGS. 3 to 5, the base plate 21 of the printing apparatus 1 has a substantially square plate shape. As depicted in FIG. 5, the base plate 21 has rectangular through holes 21A and 21B. The through hole 21A has a square shape. The through hole 21A is provided at the upper side of the center portion in the up-down direction of the base plate 21 and at the center portion in the left-right direction of the base plate 21. The through hole 21B has a rectangular shape that is long in the left-right direction. The through hole 21B is provided at the lower side of the through hole 21A. The base plate 21 includes the installation parts 22 (22A to 22G, see FIGS. 3 and 4), a fan 23, the thermal head 26, and the like.

As depicted in FIG. 4, the installation parts 22 are provided in the front surface of the base plate 21. The installation parts 22A to 22G are connected to the front ends of the shafts 92A to 92G of the ribbon cartridge 9 installed in the printing apparatus 1. The installation part 22A is provided on the upper side of the center portion in the up-down direction of the base plate 21 and on the right side of the center portion in the left-right direction of the base plate 21. The installation part 22F is provided on the upper side of center portion in the up-down direction of the base plate 21 and on the left side of the center portion in the left-right direction of the base plate 21. Each of the installation parts 22A and 22F has a circular shape. The installation parts 22A and 22F are arranged in the left-right direction. The installation part 22A is disposed on the right side of the through hole 21A. The installation part 22F is disposed on the left side of the through hole 21A. For example, when the ribbon cartridge 9 depicted in FIG. 2 is installed in the printing apparatus 1, the ribbon roll 90 wound around the spool 921 connected to the shaft 92A is installed in the installation part 22A. The spool 922 connected to the shaft 92F is installed in the installation part 22F.

As depicted in FIG. 4, the installation part 22B is provided at the upper right corner of the base plate 21. The installation part 22C is provided at the lower right corner of the base plate 21. The installation part 22D is provided at the lower left corner of the base plate 21. The installation part 22E is provided at the upper left corner of the base plate 21. The installation part 22G is provided at the upper end of the base plate 21 and at the center portion in the left-right direction of the base plate 21. As depicted in FIG. 3, a pillar-shaped support part 24 extends frontward from the circumference of the installation part 22G in the base plate 21. The support part 24 has a circular hole 24A communicating with the installation part 22G. When the ribbon cartridge 9 is installed in the printing apparatus 1, the shaft 92G of the ribbon cartridge 9 is inserted into the hole 24A of the support part 24, thus connected to the installation part 22G.

A rotation shaft of a motor 31A (see FIG. 6) described below is connected to the installation part 22A from the rear side. The installation part 22A rotates depending on the rotation of the motor 31A. A rotation shaft of a motor 31B (see FIG. 6) described below is connected to the installation part 22F. The installation part 22F rotates depending on the rotation of the motor 31B. When the installation parts 22A and 22F rotate in a state where the shafts 92A to 92G (see FIG. 2) of the ribbon cartridge 9 are respectively connected to the installation parts 22A to 22G, the ink ribbon 9A (see FIG. 2) of the ribbon cartridge 9 is conveyed in the printing apparatus 1 such that the ribbon cartridge 9 is guided between the spools 921 and 922 (see FIG. 2) while coming into contact with the shafts 92B to 92E.

As depicted in FIG. 3, the fan 23 is provided in the through hole 21A. The fan 23 is provided between the installation parts 22A and 22F. The fan 23 is a blower having rotatable blades or winds. The fan 23 has a motor built in. The front end of the fan 23 comes into contact with the front-side area relative to the base plate 21, and the rear end of the fan 23 comes into contact with the rear-side area relative to the base plate 21. Rotation of the blades of the fan 23 moves air in the rear-side area relative to the base plate 21 toward the front-side area.

The front end of the fan 23 is disposed on the slightly rear side of the front surface of the base plate 21. The rear end of the fan 23 is disposed on the slightly front side of the rear surface of the base plate 21 (see FIG. 9). Namely, the fan 23 does not extend frontward beyond the front surface of the base plate 21 and does not extend rearward beyond the rear surface of the base plate 21.

As depicted in FIGS. 3 and 4, the thermal head 26 is provided on the lower end of the front surface of the base plate 21 at a position between the installation parts 22C and 22D. The thermal head 26 is a line thermal head having heating elements arranged linearly in the front-rear direction. The thermal head 26 comes into contact with a part, of the ink ribbon 9A (see FIG. 2) that is unreeled from the ribbon roll 90 of the ribbon cartridge 9 depending on the rotation of the installation parts 22A and 22F, stretched between the shafts 92C and 92D (see FIG. 2), from the upper side. The printing medium and the ink ribbon 9A are sandwiched between the thermal head 26 and a platen roller P (see FIG. 8) disposed on the lower side of the printing apparatus 1, and the ink ribbon 9A is heated by the thermal head 26 in a state where the ink ribbon 9A is pressed against the printing medium.

As depicted in FIG. 4, the thermal head 26 is connected to an annular belt 261. The belt 261 is stretched between a gear 310 provided in the vicinity of the installation part 22D and a pulley 311 provided in the vicinity of the installation part 22C. The gear 310 rotates depending on rotation of a motor 31C (see FIG. 6) described below. The thermal head 26 is movable in the left-right direction between the vicinity of the installation part 22C and the vicinity of the installation part 22D depending on the rotation of the gear 310.

The thermal head 26 is movable in the up-down direction between a printing position depicted in FIG. 4 and a standby position (not depicted) positioned on the upper side of the printing position and a retract position positioned on the upper side of the standby position. The thermal head 26 moves in the up-down direction between the printing position and the standby position and the retract position depending on the rotation of a motor 31D described below (see FIG. 6.).

<Partition Wall 27>

As depicted in FIG. 3, the partition wall 27 is connected to the front surface of the base plate 21. The partition wall 27 includes wall parts 27A, 27B, 27C. 27D, and 27E each having a substantially plate shape. The wall part 27A is disposed along a part, of the front surface of the base plate 21, below the installation parts 22A and 22B, the through hole 21A, and the fan 23. A part of the wall part 27A covers and closes substantially a half of the upper side of the through hole 21B (see FIG. 5) of the base plate 21. The wall part 27B extends frontward from the lower end of the wall part 27A. The wall part 27B has such a shape that curved parts 271 and 272 curved downward are arranged in the left-right direction. As depicted in FIG. 4, each of the curved parts 271 and 272 has an arc shape when seen from the front side. The center of the arc when the curved part 271 disposed on the right side is seen from the front side is substantially the same as the rotation center of the installation part 22A. The center of the arc when the curved part 272 disposed on the left side is seen from the front side is substantially the same as the rotation center of the installation part 22F.

As depicted in FIG. 4, the wall part 27C extends frontward from the right end of the front surface of the base plate 21. The wall part 27D extends frontward from the left end of the front surface of the base plate 21. The wall parts 27C and 27D are orthogonal to the left-right direction. The upper end of the wall part 27C is connected to the right end of the curved part 271 of the wall part 27B. The upper end of the wall part 27D is connected to the left end of the curved part 272 of the wall part 27B. The wall parts 27B, 27C, and 27D are longer in the front-rear direction than the thermal head 26.

As depicted in FIG. 3, the wall part 27E, which is orthogonal to the front-rear direction, is connected to the front ends of the wall parts 27B, 27C, and 27D. The wall part 27E is disposed on the front side of the front end of the thermal head 26. The lower ends of the wall parts 27C, 27D, and 27E form an opening 273. As depicted in FIG. 4, the opening 273 is disposed on the upper side of the thermal head 26 positioned in the printing position. The thermal head 26 positioned in the standby position or the retract position, which is on the upper side of the printing position, is disposed on the lower side of the wall part 27B. Namely, the thermal head 26 moves in the up-down direction at the lower side of the wall part 27B of the partition wall 27.

The partition wall 27 partitions the front-side area relative to the base plate 21 into an area on the upper side of the wall part 27B (hereinafter referred to as a first area A1) and an area on the lower side of the wall part 27B (hereinafter referred to as a second area A2). The first area A1 at least includes the installation parts 22A, 22B, 22E, and 22F, the through hole 21A, and the fan 23. The second area A2 at least includes the installation parts 22C and 22D, a part, of the through hole 21B (see FIG. 5), not covered with the wall part 27A, and the thermal head 26. In the following, the part, of the through hole 21B, not covered with the wall part 27A is simply referred to as the through hole 21B.

<Drive Mechanism 30>

Figure 6:
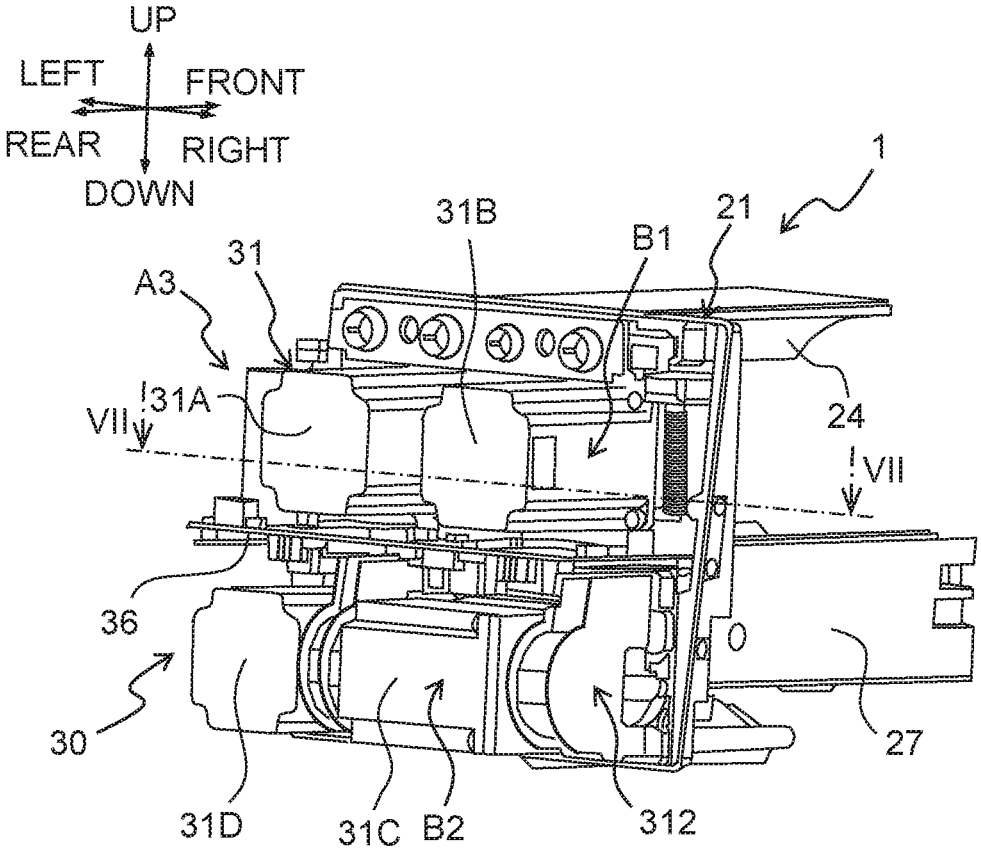
FIG. 6 is a perspective view of the printing apparatus 1 when seen from the rear side.

As depicted in FIG. 6, the motors 31A to 31D (hereinafter collectively referred to as motors 31), the control board 36, and the like are connected to the rear surface of the base plate 21. In the following, the rear-side area relative to the base plate 21 is referred to as a third area A3. The motors 31 and the control board 36 are collectively referred to as the drive mechanism 30. The drive mechanism 30 is provided in the third area A3.

As depicted in FIG. 6, the control board 36 is provided at the substantially center portion in the up-down direction of the third area A3. The control board 36 is perpendicular to the up-down direction. As depicted in FIG. 5, the control board 36 is disposed on the lower side of the upper end of the through hole 21B and on the upper side of the lower end of the through hole 21B provided in the base plate 21. The position in the up-down direction of the control board 36 is substantially the same as the position in the up-down direction of the upper end of the wall part 27B of the partition wall 27.

Figure 7:
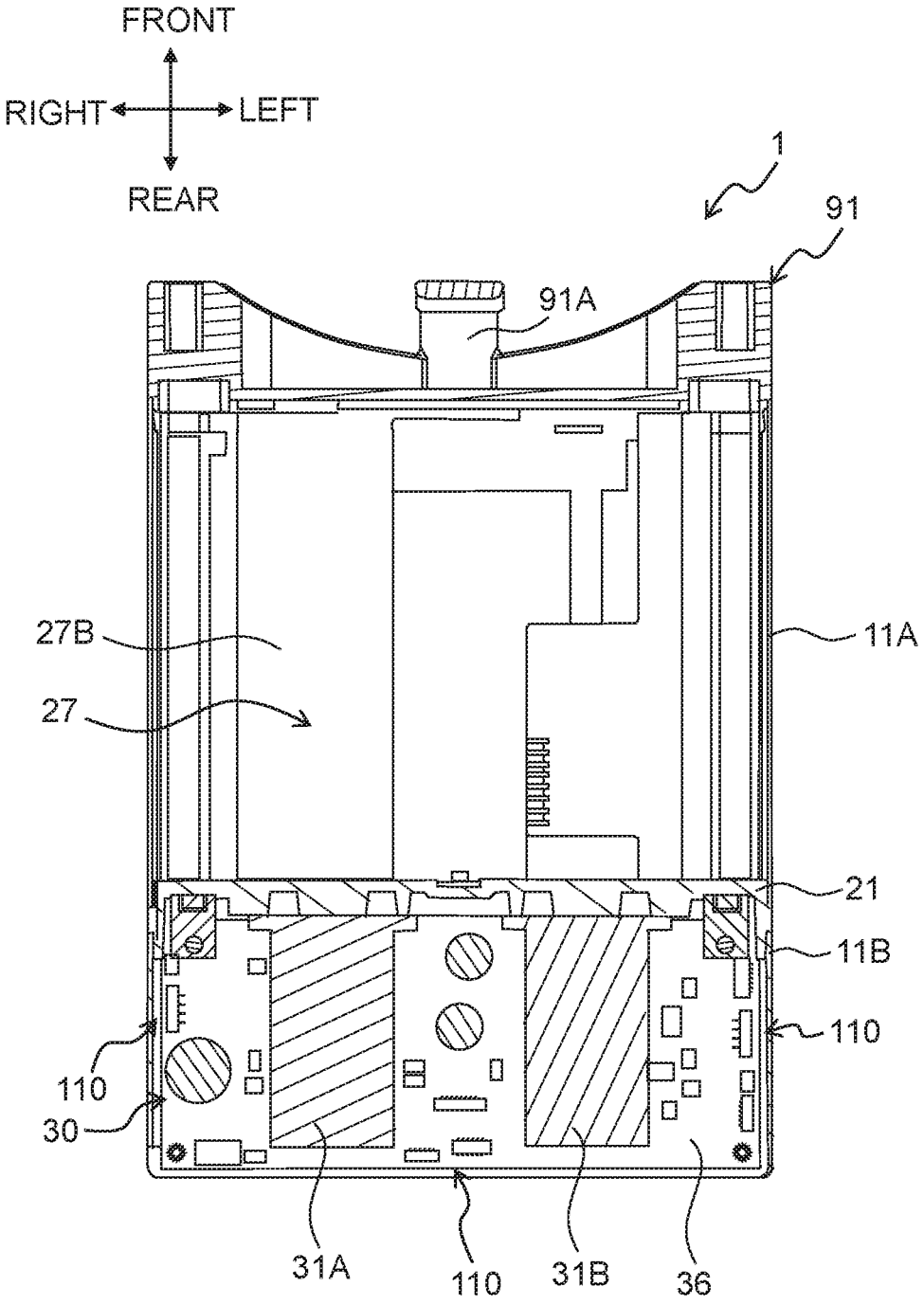
FIG. 7 is a cross-sectional view of the printing apparatus 1 taken along a line VII-VII in FIG. 6, when seen from an arrow direction in FIG. 6.

As depicted in FIG. 7, the control board 36 is slightly smaller than an area surrounded by the base plate 21 and the case 11B when seen from above. This forms a gap 110 between the inner wall of the case 11B and the circumferential edge of the control board 36. As depicted in FIG. 6, the control board 36 partitions the third area A3 into an upper partial area and a lower partial area. In the following, the upper partial area of the third area A3 relative to the control board 36 is referred to as a first partial area B1, and the lower partial area of the third area A3 relative to the control board 36 is referred to as a second partial area B2. The first partial area B1 corresponds to an area, of the third area A3, close to the first area A1 (see FIG. 3). The second partial area B2 corresponds to an area, of the third area A3, close to the second area A2 (see FIG. 3).

As depicted in FIG. 6, the control board 36 includes or mounts driver elements (a transistor, an electrolytic capacitor, and the like) for performing rotation control of the motors 31, driver elements (a transistor, an electrolytic capacitor, and the like) for performing heating control of the thermal head 26 (see FIG. 4 and the like), a CPU for controlling a variety of drive elements, and the like.

The motors 31A and 31B are provided in the first partial area B1, of the third area A3, on the upper side of the control board 36. The motor 31A is connected to a part, of the rear surface of the base plate 21, positioned on the rear side of the installation part 22A (see FIGS. 3 to 5) provided in the front surface of the base plate 21. The motor 31B is connected to a part, of the rear surface of the base plate 21, positioned on the rear side of the installation part 22F (see FIGS. 3 to 5) provided in the front surface of the base plate 21. The motors 31A and 31B are arranged in the left-right direction. The motor 31A is disposed on the left side of the motor 31B. The rotation shafts of the motors 31A and 31B pass through the base plate 21 from the rear surface to the front surface, and connected respectively to the installation parts 22A and 22F provided in the front surface of the base plate 21. The motor 31A rotates the installation part 22A, and the motor 31B rotates the installation part 22F.

The motors 31C and 31D are provided in the second partial area B2, of the third area A3, on the lower side of the control board 36. The motor 31C is connected to a part, of the rear surface of the base plate 21, on the lower side of the motor 31B. The rotation shaft of the motor 31C is connected to the gear 310 (see FIGS. 4 and 5) provided in the front surface of the base plate 21 via a coupling gear 312 provided on the right side of the motor 31C. When the gear 310 rotates depending on the rotation of the motor 31C, the belt 261 (see FIGS. 4 and 5) stretched between the gear 310 and pulley 311 rotates, moving the thermal head 26 (see FIGS. 4 and 5) connected to the belt 261 in the left-right direction.

The motor 31D is provided in a part, of the rear surface of the base plate 21, on the left side of the motor 31C. Depending on the rotation of the motor 31D, the thermal head 26 moves in the up-down direction between the printing position and the standby position and the retract position.

<Outline of Printing Operation>

Figure 8:
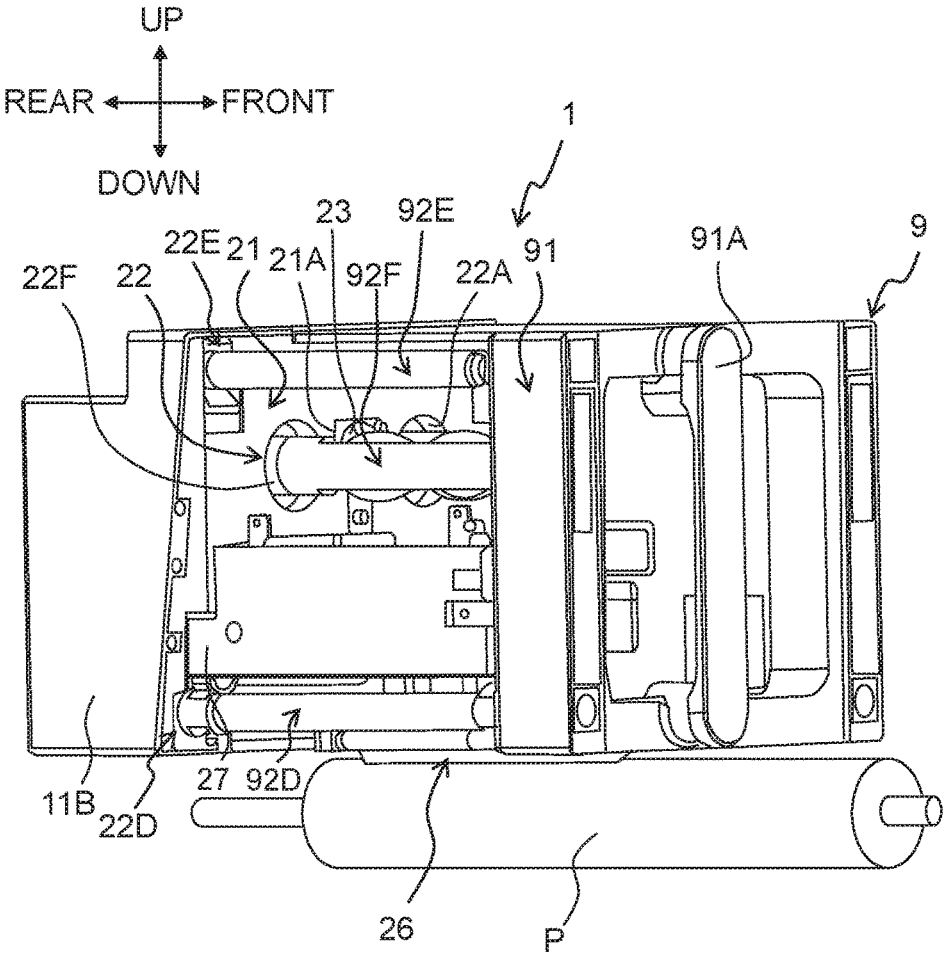
FIG. 8 is a perspective view of the ribbon cartridge 9 and the printing apparatus 1 not including the case 11A.

As depicted in FIG. 8, the ribbon cartridge 9 is installed in the printing apparatus 1. The case 11A (see FIG. 1) is omitted in FIG. 8. The shafts 92A to 92G of the ribbon cartridge 9 are connected respectively to the installation parts 22A to 22G of the base plate 21. Next, the printing apparatus 1 is disposed such that the thermal head 26 faces a printing surface of the printing medium conveyed by the external apparatus and such that a conveyance direction of the printing medium coincides with the left-right direction of the printing apparatus 1. The platen roller P is disposed on the opposite side of the printing apparatus 1 relative to the printing medium.

Figure 9:
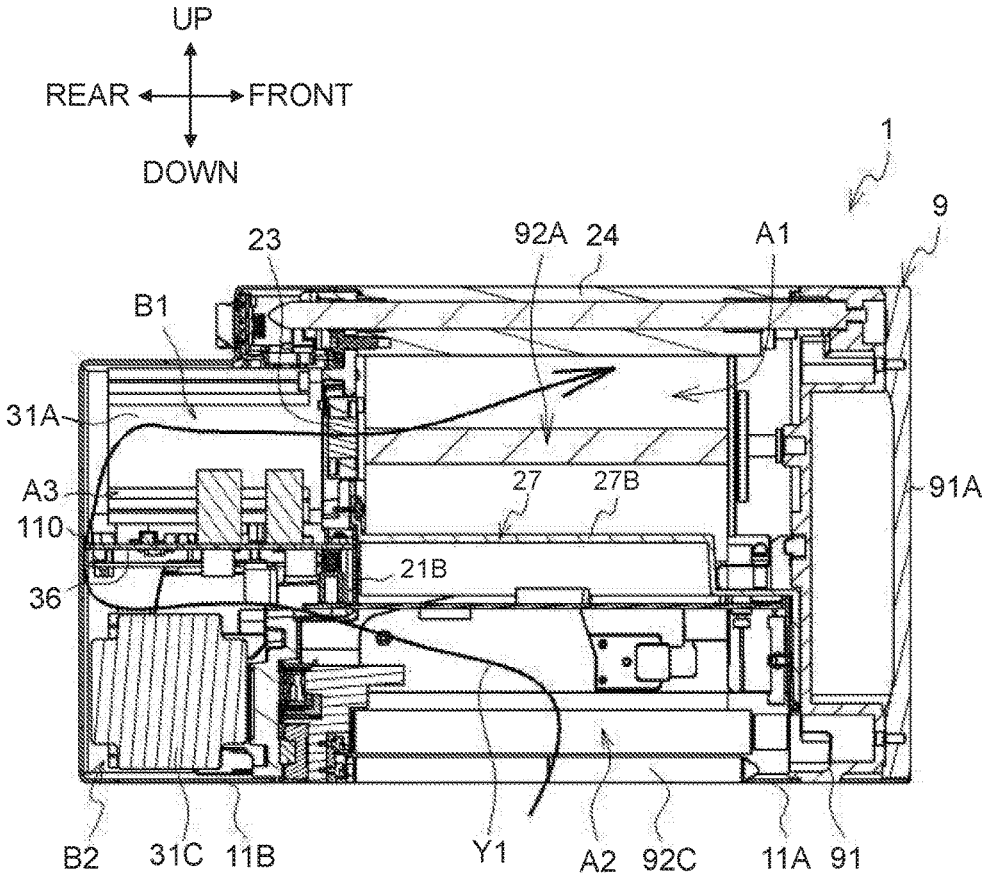
FIG. 9 is a cross-sectional view of the printing apparatus 1 taken along a line IX-IX in FIG. 1, when seen from an arrow direction in FIG. 1.

When turned on, the fan 23 starts to rotate. As depicted in FIG. 9, the fan 23 moves air in the first partial area B1 of the third area A3 toward the first area A1. Along with the airflow from the first partial area B1 to the first area A1, air in the second partial area B2 of the third area A3 passes through the gap 110 between the case 11B and the control board 36, and flows toward the first partial area B1 of the third area A3. Along with the airflow from the second partial area B2 to the first partial area B1, air in the second area A2 passes through the through hole 21B and flows toward the second partial area B2. Since the lower end of the case 11A is open, air flows into the second area A2 from the outside along with the airflow from the second area A2 to the second partial area B2. Namely, the drive of the fan 23 generates the airflow (an arrow Y 1) from the second area A2 to the first area A1 via the third area A3 (the first partial area B1 and the second partial area B2).

When the printing apparatus 1 starts the printing operation, the installation parts 22A and 22F rotate in response to the drive of the motors 31A and 31B, thus rotating the shafts 92A and 92F of the ribbon cartridge 9 connected to the installation parts 22A and 22F. The ink ribbon 9A is reeled out from the ribbon roll 90 of the spool 921 attached to the shaft 92A, and then wound round the spool 922 attached to the shaft 92F. A part of the ink ribbon 9A between the shafts 92C and 92D moves in the same direction as the conveyance direction of the printing medium.

The motors 31A and 31B generate heat by being driven. The driver elements of the control board 36 that drive and control the motors 31A and 31B generate heat by driving the motors 31A and 31B. Meanwhile, driving the fan 23 generates airflow in the third area A3. The airflow cools the motor 31 and the driver elements of the control board 36.

When a conveyance speed of the ink ribbon 9A has reached a predefined speed, the motor 31D is driven to move the thermal head 26 from the retract position to the printing position via the standby position. The thermal head 26 comes into contact with the platen roller P from above via the ink ribbon 9A and the printing medium (see FIG. 9). The ink ribbon 9A is pressed against the printing surface of the printing medium depending on the movement of the thermal head 26. The platen roller P comes into contact with a surface of the printing medium on the side opposite to the printing surface, pressing the ink ribbon 9A and the printing medium against the thermal head 26. This heats the thermal head 26, transferring the ink of the ink ribbon 9A to the printing surface of the printing medium. Accordingly, the printing apparatus 1 performs the printing.

<Action and Effect of This Embodiment>

As described above, in the printing apparatus 1, the fan 23 moves air in the third area A3 from the second area A2 side to the first area A1 side. This allows the printing apparatus 1 to cool the drive mechanism 30 (the motor 31 and the control board 36) provided in the third area A3 by using the airflow generated by the fan 23. When the fan 23 generates the airflow (arrow Y 1), air flows from the second area A2 to the first area A1 via the third area A3. Meanwhile, the printing apparatus 1 includes the partition wall 27 to separate the first area A1 from the second area A2. The partition wall 27 of the printing apparatus 1 thus prevents dust and the like carried along with the airflow toward the first area A1, from falling on the second area A2. Accordingly, the partition wall 27 of the printing apparatus 1 prevents dust and the like carried along with the airflow from affecting the printing medium for which printing is performed by the thermal head 26 in the second area A2.

In the printing apparatus 1, the fan 23 is provided in the base plate 21 at a position in contact with the first area A1. In this configuration, a flow rate of the airflow from the second area A2 to the third area A3 can be smaller than a flow rate of the airflow from the third area A3 to the first area A1. In that case, a flow rate of airflow generated in the second area A2 by the fan 23 can be weakened, preventing dust and the like carried along with the airflow in the second area A2 from affecting the printing medium.

The through hole 21A is disposed between the installation parts 22A and 22F. In that configuration, a part of the ribbon roll 90 installed in the installation parts 22A and 22F may cover a part of the through hole 21A from the front side. For example, when the ribbon roll 90 entirely covers the through hole 21A, the fan 23 may not satisfactorily generate the airflow from the third area A3 to the first area A1.

In the printing apparatus 1, however, the fan 23 is disposed in the base plate 21 at a position between the installation parts 22A and 22F. In that configuration, for example, when the entirety of the ink ribbon 9A is wound in a roll shape around the spool 921 and installed in the installation part 22A, a part of the through hole 21A on the installation part 22F side is not covered with the ribbon roll 90. Similarly, when the entirety of the ink ribbon 9A is wound in a roll shape around the spool 922 and installed in the installation part 22F, a part of the through hole 21A on the installation part 22A side is not covered with the ribbon roll 90. Further, a part of the through hole 21A is not covered with the ribbon roll 90 throughout a process during which the ink ribbon 9A is reeled out from the ribbon roll 90, which is wound around the spool 921 attached to the installation part 22A, and then wound around the spool 922 attached to the installation part 22F. The printing apparatus 1 can thus reduce the possibility that the ribbon roll 90 installed in the installation parts 22A and 22F interferes with the airflow from the third area A3 to the first area A1.

The fan 23 does not extend frontward beyond the front surface of the base plate 21 and does not extend rearward beyond the rear surface of the base plate 21. In that configuration, the printing apparatus 1 can prevent the fan 23 from interfering with installation of the ribbon roll 90 in the installation parts 22A and 22F. Further, the printing apparatus 1 can prevent the fan 23 from interfering with the drive mechanism 30 provided in the third area A3.

The control board 36, on which the drive elements driving the motor 31, and the like are mounted, partitions the third area A3 into the first partial area B1 on the first area A1 side and the second partial area B2 on the second area A2 side. The gap 110 is formed between the control board 36 and the case 11B. Air moves from the second partial area B2 to the first partial area B1 via the gap 110. The gap 110 of the printing apparatus 1 can thus reduce the possibility that the control board 36 interferes with the airflow in the third area A3.

<Modified Embodiment>

The present disclosure is not limited to the above embodiment, and it is possible to make various changes or modifications in the above embodiment. Two or more pieces of the fan 23 may be provided in the printing apparatus 1 without being limited to the single fan 23 as in the above embodiment. The fan 23 may be provided at any position of the base plate 21 which is in contact with the first area A1 without being limited to the position of the base plate 21 between the installation parts 22A and 22F. For example, the fan 23 may be provided on the upper side of the installation parts 22A and 22F.

In the above embodiment, the fan 23 is provided in the through hole 21A that is in contact with the first area A1 of the base plate 21. The fan 23, however, may be provided in the through hole 21B that is in contact with the second area A2 of the base plate 21. In that configuration, the fan 23 may rotate so that air flows from the second area A2 to the second partial area B2 of the third area A3. Similar to the above embodiment, this configuration allows the fan 23 to generate the airflow from the second area A2 to the first area A1 via the third area A3. Further, the fan 23 may be provided both in the through holes 21A and 21B.

The fan 23 may be provided on the front side of the through hole 21A. In that configuration, the fan 23 may extend frontward beyond the front surface of the base plate 21. Similarly, the fan 23 may be provided on the rear side of the through hole 21A. In that configuration, the fan 23 may extend rearward beyond the base plate 21. Those configurations make installation of the fan 23 in the base plate 21 easy.

The control board 36 may have a through hole. Air may move from the second partial area B2 to the first partial area B1 via the through hole. In that configuration, the gap 110 may not be formed between the case 11B and the control board 36. The third area A3 may only include the motor 31. In that configuration, the third area A3 may not include the control board 36.

What is claimed is:

1. A printing apparatus, comprising:

a base plate including a first surface and a second surface;

an installation part provided in the first surface of the base plate to be rotatable and configured so that a ribbon roll, around which an ink ribbon is wound, is attached thereto;

a thermal head provided in the first surface of the base plate and configured to heat the ink ribbon, which is reeled out or unreeled from the ribbon roll depending on rotation of the installation part;

a partition wall partitioning the first surface of the base plate into a first area including the installation part and a second area including the thermal head;

a drive mechanism provided in a third area of the second surface of the base plate and including a motor configured to rotate the installation part and a controller configured to control the motor; and a fan provided in the base plate and configured to move air from the second area to the first area via the third area.

2. The printing apparatus according to claim 1, wherein the fan is disposed in the base plate at a position in contact with the first area.

3. The printing apparatus according to claim 2, wherein the installation part is one of a plurality of installation parts including a first installation part to which a first spool connected to a first end of the ink ribbon is attached; and a second installation part to which a second spool connected to a second end of the ink ribbon is attached, and the fan is positioned in the base plate at a position between the first installation part and the second installation part.

4. The printing apparatus according to claim 1, wherein the fan does not extend beyond the first surface of the base plate in a direction oriented from the second surface toward the first surface and does not extend beyond the second surface of the base plate in a direction oriented from the first surface toward the second surface.

5. The printing apparatus according to claim 1, wherein the controller includes a control board mounted with a device configured to drive the motor, the control board partitions the third area into a first partial area closer to the first area than to the second area and a second partial area closer to the second area than to the first area, and the control board includes an air flowing part allowing air to flow between the first partial area and the second partial area.

* * * * *